US012410982B2

(12) United States Patent
Alexander et al.

(10) Patent No.: US 12,410,982 B2
(45) Date of Patent: Sep. 9, 2025

(54) MULTIPLE-BARREL FIREARM AND METHOD OF USE

(71) Applicant: TMP WEAPONS, LLC, Reno, NV (US)

(72) Inventors: Joshua Phillip Alexander, Scottsdale, AZ (US); Wade Karl Schmidt, New River, AZ (US); Stephen McKinnley Estep, New River, AZ (US)

(73) Assignee: TMP Weapons, LLC, Reno, NV (US)

( * ) Notice: Subject to any disclaimer, the term of this patent is extended or adjusted under 35 U.S.C. 154(b) by 0 days.

(21) Appl. No.: 18/390,635

(22) Filed: Dec. 20, 2023

(65) Prior Publication Data

US 2025/0207882 A1 Jun. 26, 2025

(51) Int. Cl.

| | |
|---|---|
| ***F41A 21/06*** | (2006.01) |
| ***F41A 9/30*** | (2006.01) |
| ***F41A 13/10*** | (2006.01) |
| ***F41A 21/32*** | (2006.01) |
| ***F41A 21/48*** | (2006.01) |

(52) U.S. Cl.

CPC ..... *F41A 21/06* (2013.01); *F41A 9/30* (2013.01); *F41A 13/10* (2013.01); *F41A 21/325* (2013.01); *F41A 21/48* (2013.01)

(58) Field of Classification Search

CPC ..... F41F 1/08; F41F 1/085; F41F 1/10; F41A 3/60; F41A 9/29–31; F41A 9/35–36; F41A 13/10; F41A 19/18; F41A 19/68; F41A 21/06; F41A 21/08; F41A 21/325; F41A 21/48

USPC ..... 89/1.41, 126, 9, 12

See application file for complete search history.

(56) References Cited

U.S. PATENT DOCUMENTS

| | | | | | |
|---|---|---|---|---|---|
| 2,849,921 | A * | 9/1958 | Otto | F41F 1/10 | 89/126 |
| 3,041,939 | A * | 7/1962 | Dardick | F41A 19/58 | 89/126 |
| 3,380,341 | A * | 4/1968 | Chiabrandy | F41F 1/10 | 89/12 |
| 3,834,272 | A * | 9/1974 | Patenaude | F41F 1/10 | 89/190 |
| 3,921,499 | A * | 11/1975 | Ginsky | F41A 17/16 | 89/12 |
| 4,574,682 | A * | 3/1986 | Hillman | F41A 21/32 | 89/14.3 |
| 5,817,967 | A * | 10/1998 | Simon | F41A 9/45 | 89/13.05 |
| 6,443,044 | B1 * | 9/2002 | Dillon | F41A 9/36 | 89/12 |

(Continued)

*Primary Examiner* — Troy Chambers
*Assistant Examiner* — Benjamin S Gomberg
(74) *Attorney, Agent, or Firm* — Procopio, Cory , Hargreaves & Savitch LLP

(57) ABSTRACT

A machine gun comprising a gun housing; a rotor assembly positioned within the gun housing; a barrel cluster including a plurality of barrels extending forward from the rotor assembly; one or more vents providing a path for expulsion away from the rotor assembly of gases emanating from a cartridge chambered in one of the plurality of barrels; and one or more of a rotor lock mechanism, a feed mechanism, a delinking and transfer mechanism, a searing mechanism, a drive system, a self-contained hardware barrel clamp, a threaded adapter barrel clamp, integrated mounts, and/or multiple feed inlet locations.

14 Claims, 15 Drawing Sheets

(56) References Cited

U.S. PATENT DOCUMENTS

| | | | | |
|---|---|---|---|---|
| 10,871,336 | B1 * | 12/2020 | Johnston | F41A 19/68 |
| 11,371,792 | B1 * | 6/2022 | Garwood | G01P 3/50 |
| 11,385,005 | B1 * | 7/2022 | Garwood | F41A 13/10 |
| 2008/0092726 | A1 * | 4/2008 | Dillon | F41A 13/06 89/12 |
| 2012/0227577 | A1 * | 9/2012 | Dillon | F41F 1/10 89/12 |
| 2023/0092536 | A1 * | 3/2023 | Paulson | F41F 1/10 89/12 |
| 2023/0251053 | A1 * | 8/2023 | Paulson | F41A 21/06 181/223 |

* cited by examiner

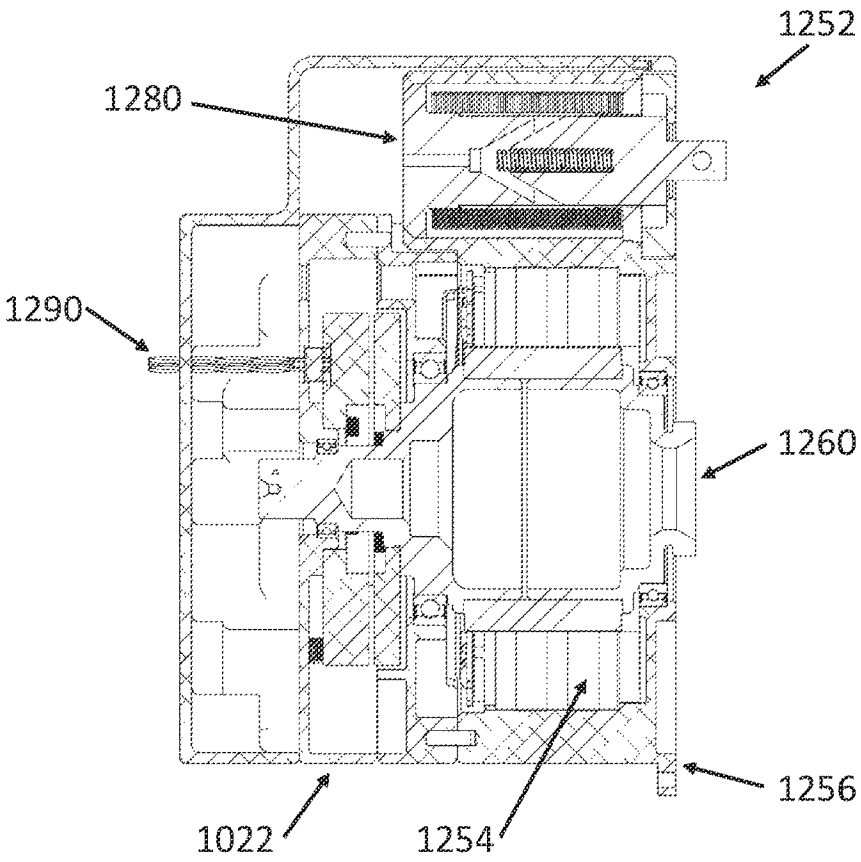
FIG. 9
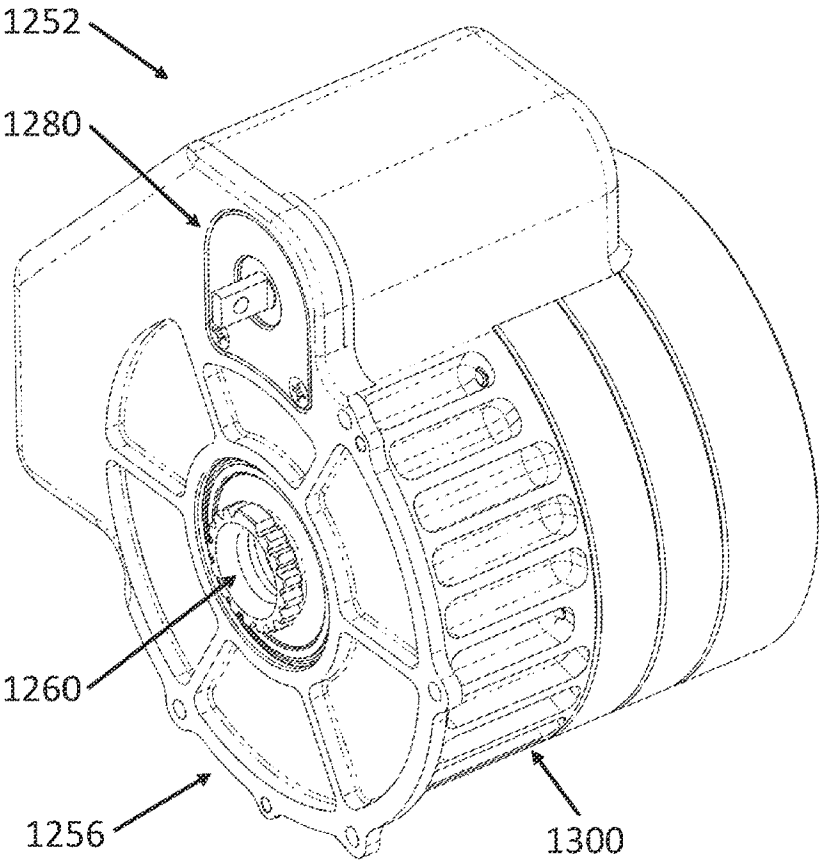

MULTIPLE-BARREL FIREARM AND METHOD OF USE

FIELD OF THE INVENTION

The present invention relates in general to multiple-barrel firearms and in particular to electric motor-driven multiple-barrel firearms.

SUMMARY OF THE INVENTION

An aspect of the invention involves a multiple-barrel firearm that has similar barrel spacing, bolt assemblies, and bolt cam path as existing M134 platforms, but utilizes alternative ammunition feeding, delinking, and transfer mechanisms. The multiple-barrel firearm is nearly half the weight of any existing M134 platform and utilizes a mechanical barrel cluster rotational lock for absolute safety when the system is in safe condition. The drive system utilizes a brushless DC servo motor with closed loop positional feedback for precise control of all rotating components. The multiple-barrel firearm has a longitudinal bolt searing safety mechanism, self-contained hardware barrel clamp with threaded adapter for various muzzle devices, integrated suspension lug mounting provisions, as well as multiple feed inlet locations for optimal feed chute orientation.

Another aspect of the invention involves a machine gun comprising a gun housing; a rotor assembly positioned within the gun housing; a barrel cluster including a plurality of barrels extending forward from the rotor assembly; one or more vents providing a path for expulsion away from the rotor assembly of gases emanating from a cartridge chambered in one of the plurality of barrels; and one or more of a rotor lock mechanism, a feed mechanism, a delinking and transfer mechanism, a searing mechanism, a drive system, a self-contained hardware barrel clamp, a threaded adapter barrel clamp, integrated mounts, and/or multiple feed inlet locations.

One or more implementations of the aspect of the invention described immediately above includes one or more of the following: a motor configured to rotate the rotor assembly, a motor housing, and the rotor lock mechanism configured to lock the rotor assembly relative to the motor housing, preventing any rotation of the barrel cluster to ensure safety; a bonded clutch solenoid, an external control interface, and a gun control module including a processor and one or more software modules that are configured to, when executed by the processor, respond to external control signals to disengage bonded clutch solenoid, stopping rounds from being fed into the rotor assembly, the gun control module further configured to control the motor to run any remaining rounds through the firing cycle and spin the barrel cluster multiple times to ensure chambers are clear, and electrically safe the machine gun; the feed mechanism includes a feeder sprocket that is concentric to and rotates in an opposite direction of the barrel cluster so as to cause an inertial load of the feed mechanism to counteract an inertial load of the barrel cluster; the delinking and transfer mechanism including a reciprocating delinking shuttle and a barrel cam operably associated with the reciprocating delinking shuttle to control linear movement of a reciprocating delinking shuttle to delink and transfer each round; the searing mechanism having a longitudinally movable bolt searing ramp, allowing additional safety to control firing pin action; the drive system having a feedback control loop with a brushless DC servo motor, a position encoder sensor, and a programmable gun control module, allowing variable rate of fire, and current and temperature sensing to offer instantaneous system status and motor control; the motor configured to rotate the rotor assembly and a motor housing with cooling features, transferring excess heat to ambient environment; the self-contained hardware barrel clamp configured to prevent each barrel from rotating about its own axis; a lock housing with a slot, a lock plunger, and the spring-loaded rotating barrel lock whereby the barrel clamp is removed via tool inserted into the slot so that force is applied to the lock plunger, rotating spring-loaded rotating barrel lock, and allowing the barrel clamp to slide off the barrel cluster; the plurality of barrels include respective non-threaded barrel end portions and the machine gun further including the threaded adapter barrel clamp with threads to mount a multitude of muzzle devices to the non-threaded barrel end portions; one or more stabilizer adapters; the one or more stabilizer adapters include integrated mounts for suspension lugs; the one or more stabilizer adapters include load transferring pads; the feed mechanism includes a feed mechanism housing configured to allow for multiple feed inlet locations to optimize feed chute orientation based on system application; and/or the feed mechanism includes a feed chute inlet, a feeder door adapter, and one or more feeder closeouts, the feed mechanism housing includes a bottom, sides, and a top, and the feed mechanism housing is configured to allow for the feed chute inlet at the bottom of the feed mechanism housing with the feeder door adapter mounted to a lowest position and the one or more feeder closeouts located in the top of the feed mechanism housing, allow for the feed chute inlet at one of the sides of the feed mechanism housing with feeder door adapter mounted to one of the sides of the feed mechanism housing and the one or more feeder closeouts located in remaining open slots of the feed mechanism housing, and allow for the feed chute inlet at the top of the feed mechanism housing with feeder door adapter mounted to the top of the feed mechanism housing and the one or more feeder closeouts located in remaining open slots of the feed mechanism housing.

BRIEF DESCRIPTION OF DRAWINGS

The accompanying drawings, which are incorporated in and form a part of this specification illustrate embodiments of the invention and together with the description, explain the principles of the invention.

FIG. 9 illustrates perspective/cross-sectional views of a drive system of the multiple-barrel firearm of FIG. 1.

DESCRIPTION OF EMBODIMENT OF THE INVENTION

Figure 1:
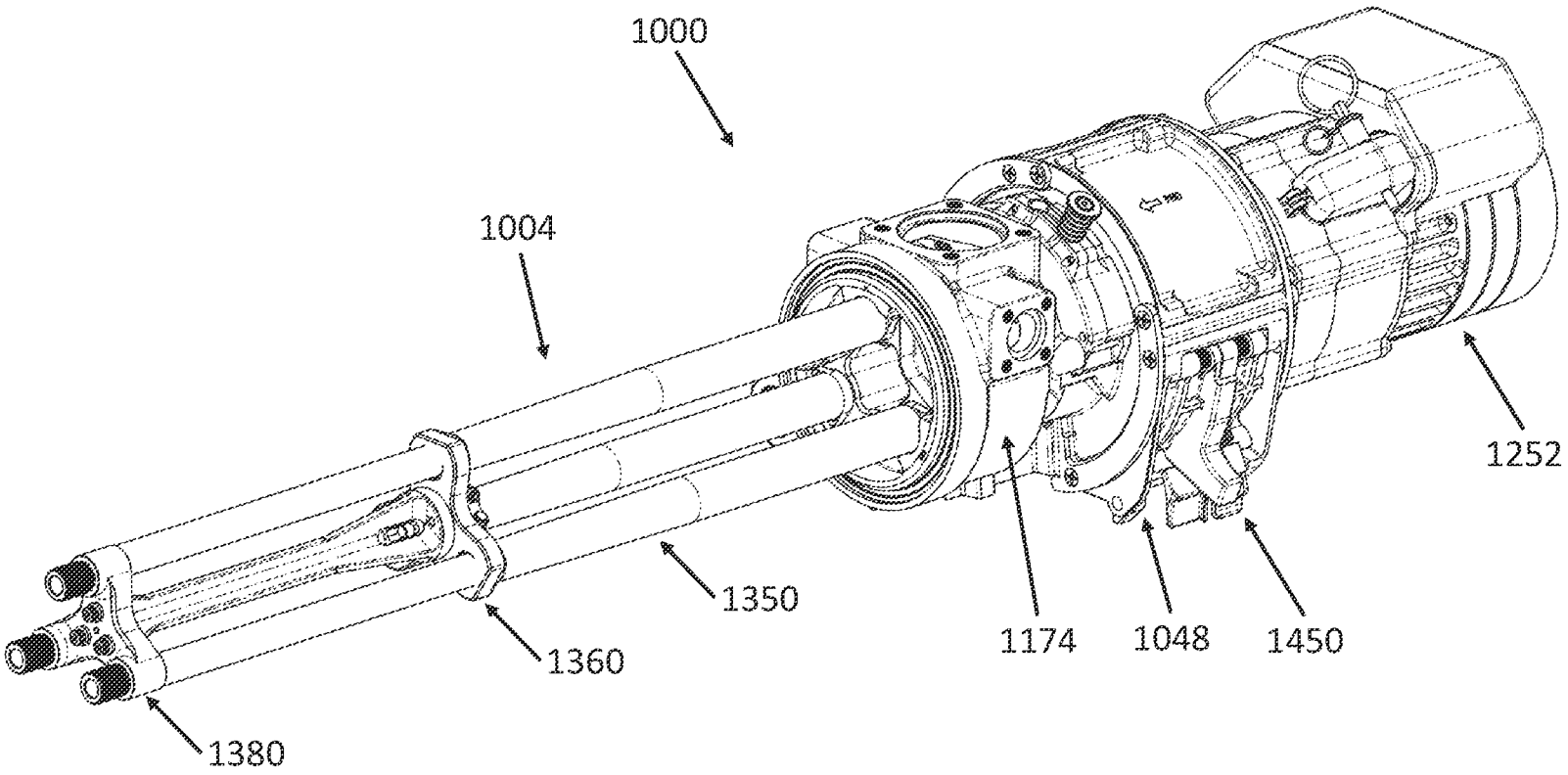
FIG. 1 is a perspective view of an embodiment of a multiple-barrel firearm.
Figure 2:
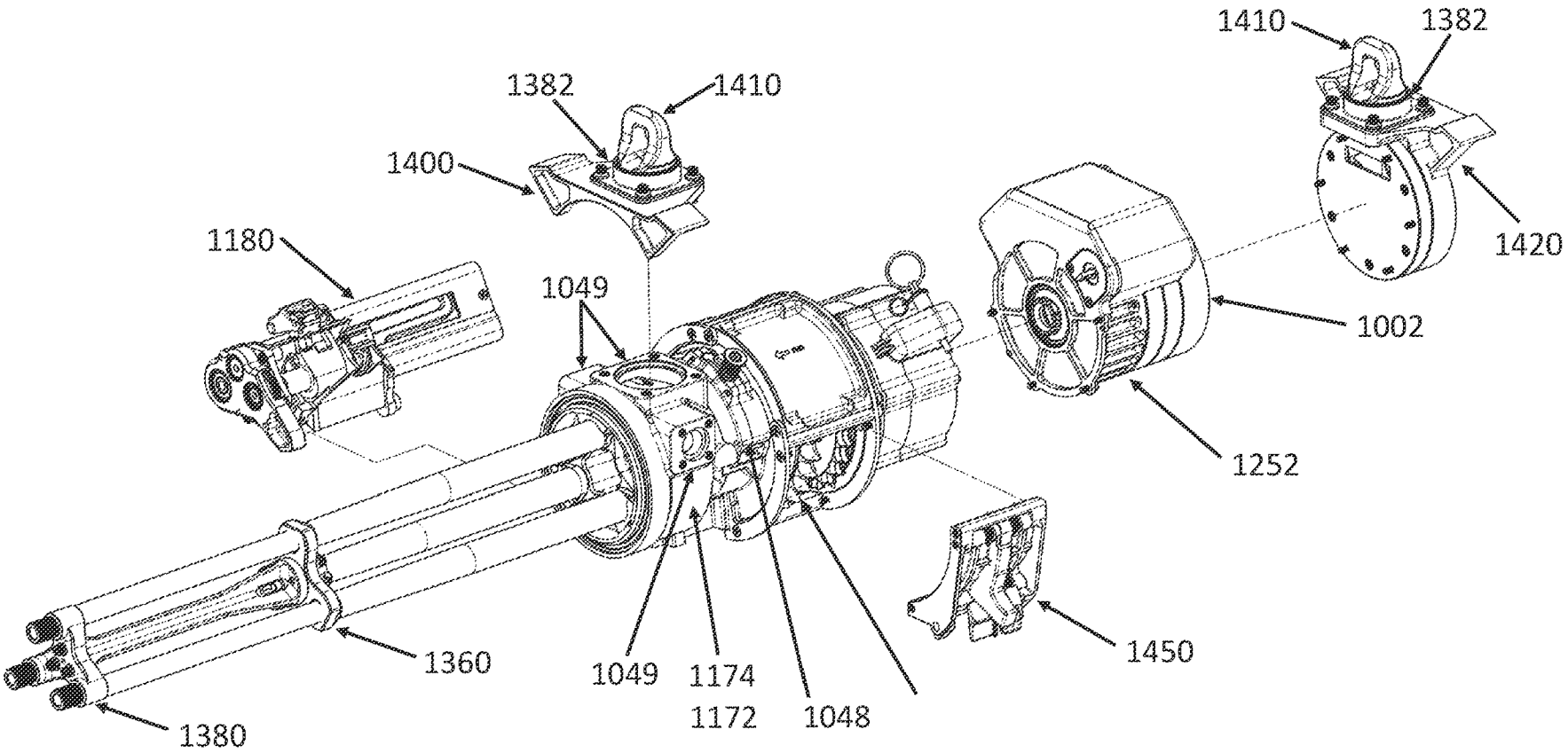
FIG. 2 is an exploded perspective view of the multiple-barrel firearm of FIG. 1.
Figure 3:
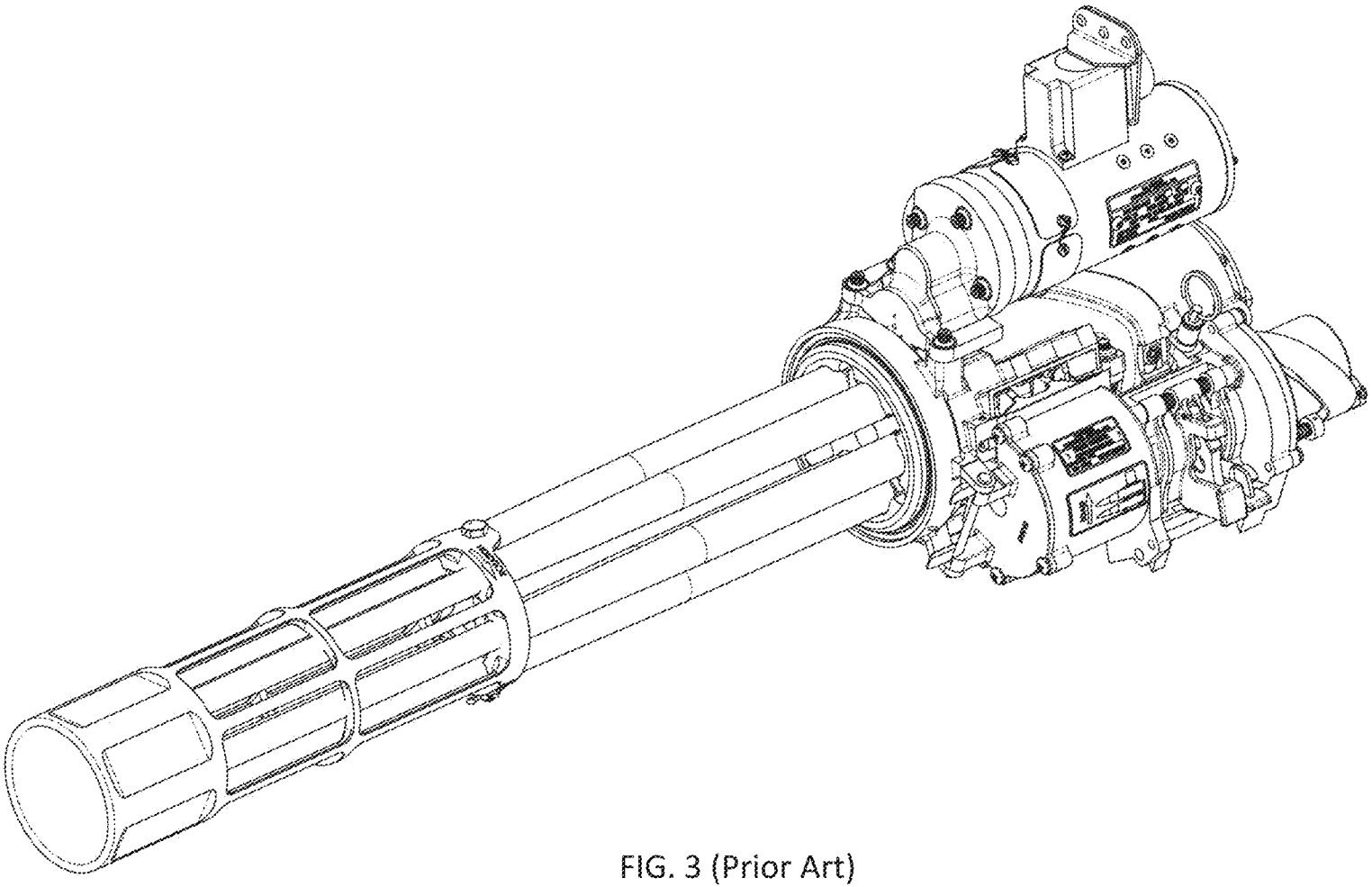
FIG. 3 (Prior Art)
FIG. 3 is a front view of a prior art M134G multiple-barrel firearm.
Figure 4:
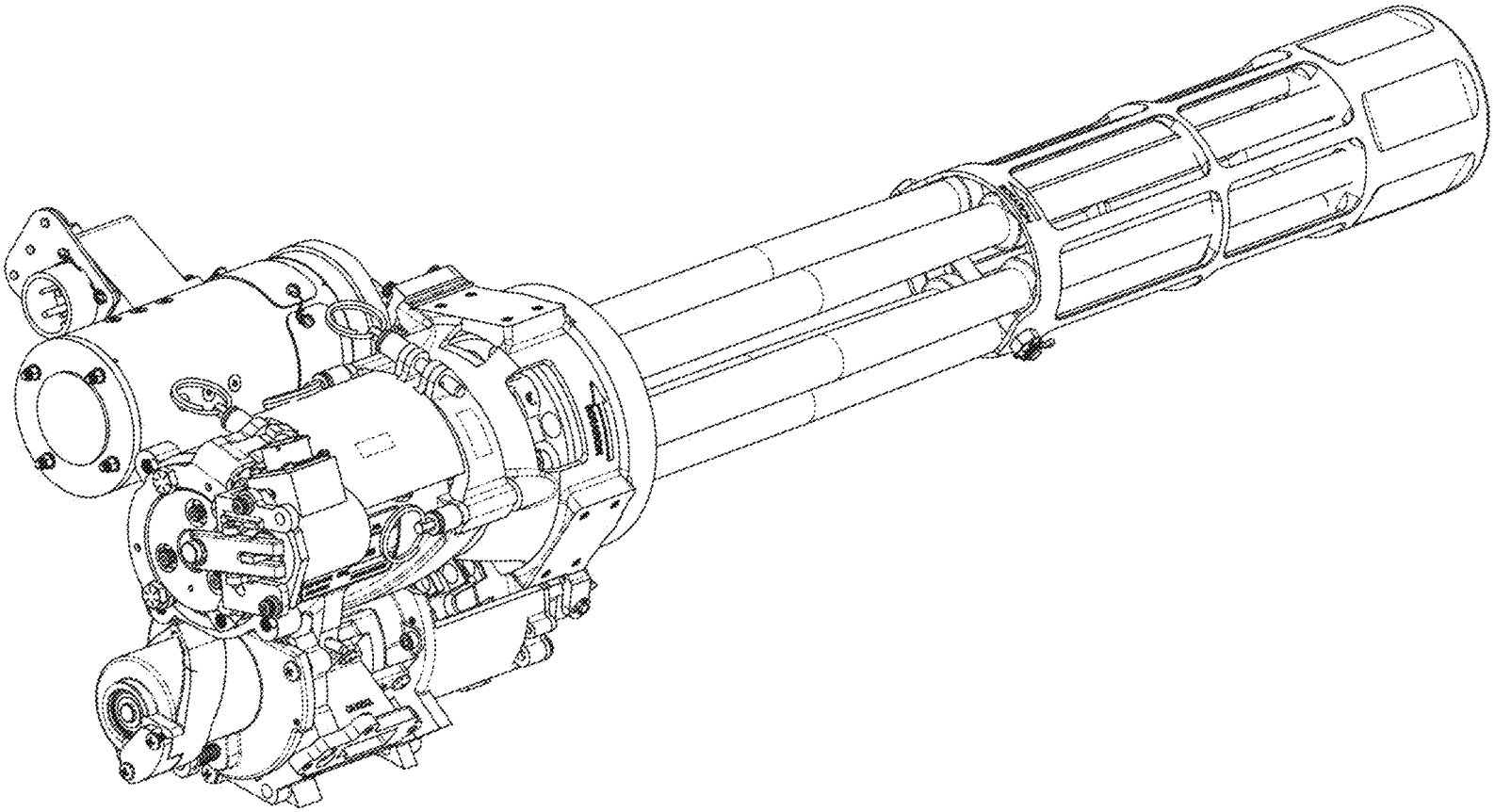
FIG. 4 (Prior Art)
FIG. 4 is a rear view of the prior art M134G multiple-barrel firearm of FIG. 3.

With reference to FIGS. 1-15, an embodiment of a multiple-barrel firearm/machine gun 1000 will be described. The machine gun 1000 includes a gun housing 1174; a rotor assembly 1030 positioned within the gun housing 1174; a barrel cluster 1004 including a plurality of barrels 1350 extending forward from the rotor assembly 1030; one or more vents 1176 providing a path for expulsion away from the rotor assembly 1030 of gases emanating from a cartridge chambered in one of the plurality of barrels 1350. The machine gun 1000 includes a rotor lock mechanism 1002 (FIGS. 2, 5), a feed mechanism 1048 (FIGS. 2, 6), a delinking and transfer mechanism 1100 (FIGS. 2, 7), a searing mechanism 1192 (FIGS. 2, 8), a drive system 1252 (FIGS. 2, 9, 15), a self-contained hardware barrel clamp 1360 (FIGS. 2, 10), a threaded adapter barrel clamp 1362 (FIGS. 2, 11), integrated mounts 1382 (FIGS. 2, 12), multiple feed inlet locations 1422 (FIGS. 2, 13), each of which will be described in turn below.

Figure 5:
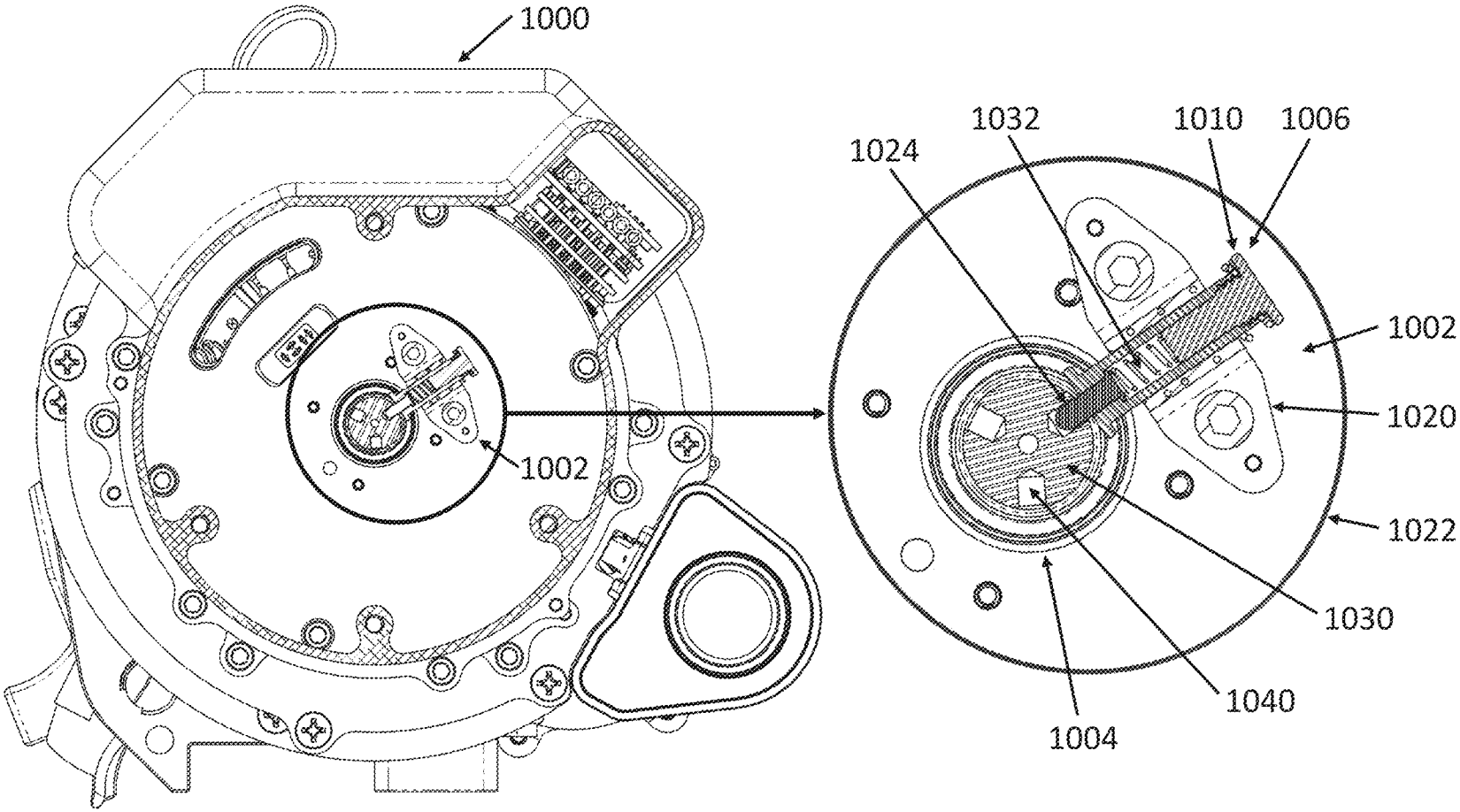
FIG. 5 illustrates cross-sectional views of a rotor lock mechanism of the multiple-barrel firearm of FIG. 1.

With reference to FIG. 5, a rotor lock mechanism 1002 of the multiple-barrel machine gun 1000 will be described. The machine gun 1000 includes a motor (e.g., brushless DC servo motor) 1254 configured to rotate the rotor assembly 1030, a motor housing 1256 (with aft motor housing 1022), and the rotor lock mechanism 1002, which is configured to lock the rotor assembly 1030 relative to the motor housing 1256, preventing any rotation of the barrel cluster 1004 to ensure safety. The rotor lock mechanism 1002 includes a mechanical rotational lock 1006 that activates when the operator sets the machine gun 1000 to SAFE to ensure machine gun 1000 is in an absolute safe condition. The rotor lock mechanism 1002 includes a barrel cluster rotational lock mount 1020, rotor lock plunger 1024, spring 1032, and rotor assembly holes 1040. The barrel cluster rotational lock mount 1020 is fixed to the aft motor housing 1022, which precisely locates rotor lock shuttle 1010 to allow for translational movement of rotor lock plunger 1024 to be either engaged or disengaged with rotor assembly 1030. In SAFE condition, the rotor lock plunger 1024 is spring-loaded via spring 1032 to engage holes 1040 in rotor assembly 1030, preventing any rotation of barrel cluster to ensure absolute safety. When the machine gun 1000 is set to ARMED condition, the rotor lock shuttle 1010 is spring-loaded open via the spring 1032, ensuring the rotor lock plunger 1024 is clear of rotating rotor assembly 1030, allowing for rotation of the barrel cluster 1004 to fire rounds. The rotor lock mechanism 1002 locks the rotor assembly 1030 relative to the motor housing 1256.

Figure 6:
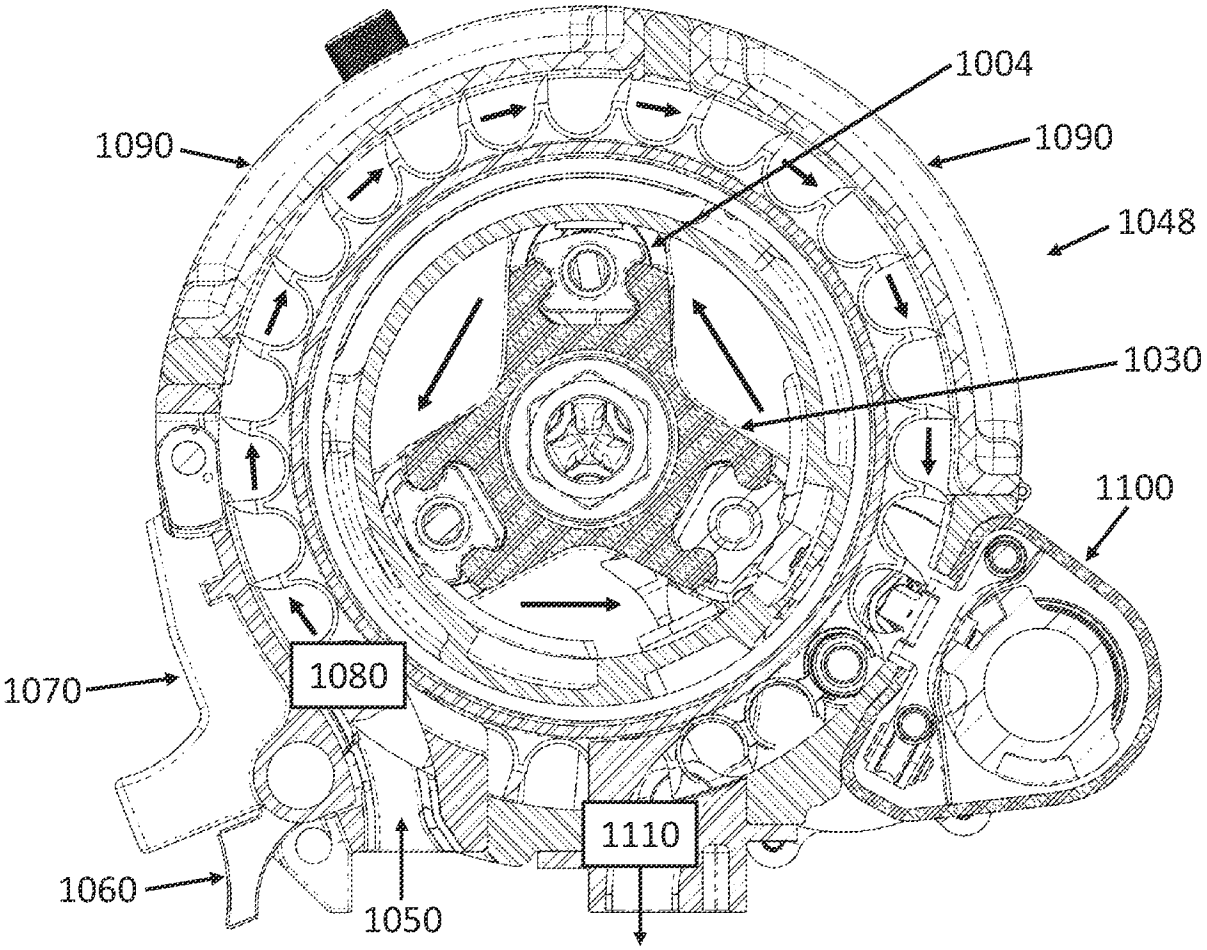
FIG. 6 is a cross-sectional view of a feed mechanism of the multiple-barrel firearm of FIG. 1.

With reference to FIG. 6, a feed mechanism 1048 of the multiple-barrel machine gun 1000 will be described. The feed mechanism 1048 includes a feeder sprocket 1080 that is concentric to and rotates in an opposite direction of the barrel cluster 1004 so as to cause an inertial load of the feed mechanism 1048 to counteract an inertial load of the barrel cluster 1004, resulting in nearly zero rotational inertial load at mounting location 1049 (FIG. 2) as the inertial loads of feed mechanism 1048 and barrel cluster 1004 counteract each other. The feed mechanism 1048 includes ammo retaining lever 1060, feeder door 1070, feed chute adapter inlet 1050, feeder closeout panels 1090, and exhaust chute 1110. With ammo retaining lever 1060 and feeder door 1070 in an open position, rounds are loaded into the firearm 100 system at feed chute adapter inlet 1050. The ammo retaining lever 1060 is then closed, holding rounds inside feeder sprocket 1080 until the feeder door 1070 is closed. Rounds will rotate inside feeder sprocket 1080 while being guided by feeder closeout panels 1090 around machine gun 1000 until they reach delinking and transfer mechanism 1100. After ammunition has been delinked, the rounds will be transferred into rotor assembly 1030 and the remaining links continue rotating inside feeder sprocket 1080 until they are disposed of through the link exhaust chute 1110.

Figure 7:
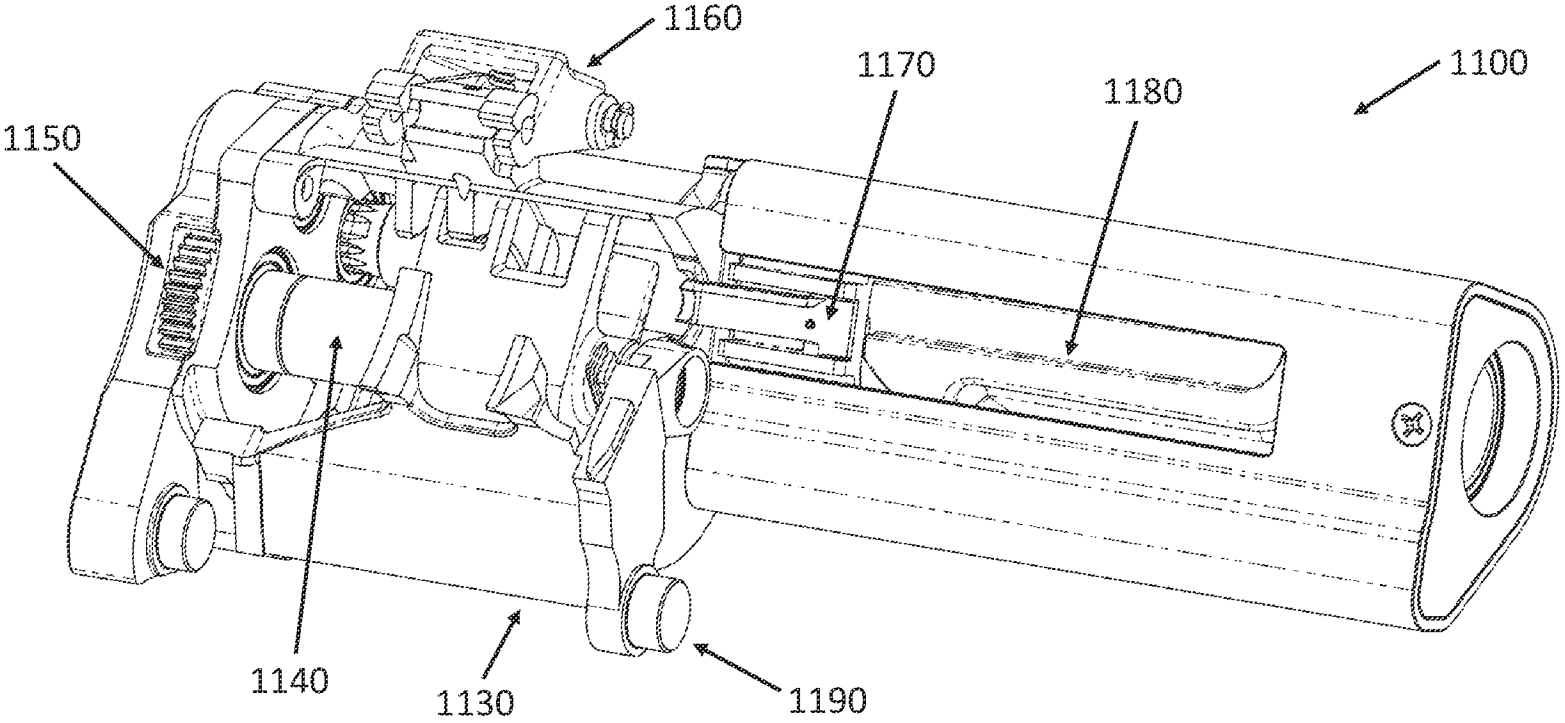
FIG. 7 is a perspective view of a delinking and transfer mechanism of the multiple-barrel firearm of FIG. 1.
Figure 14:
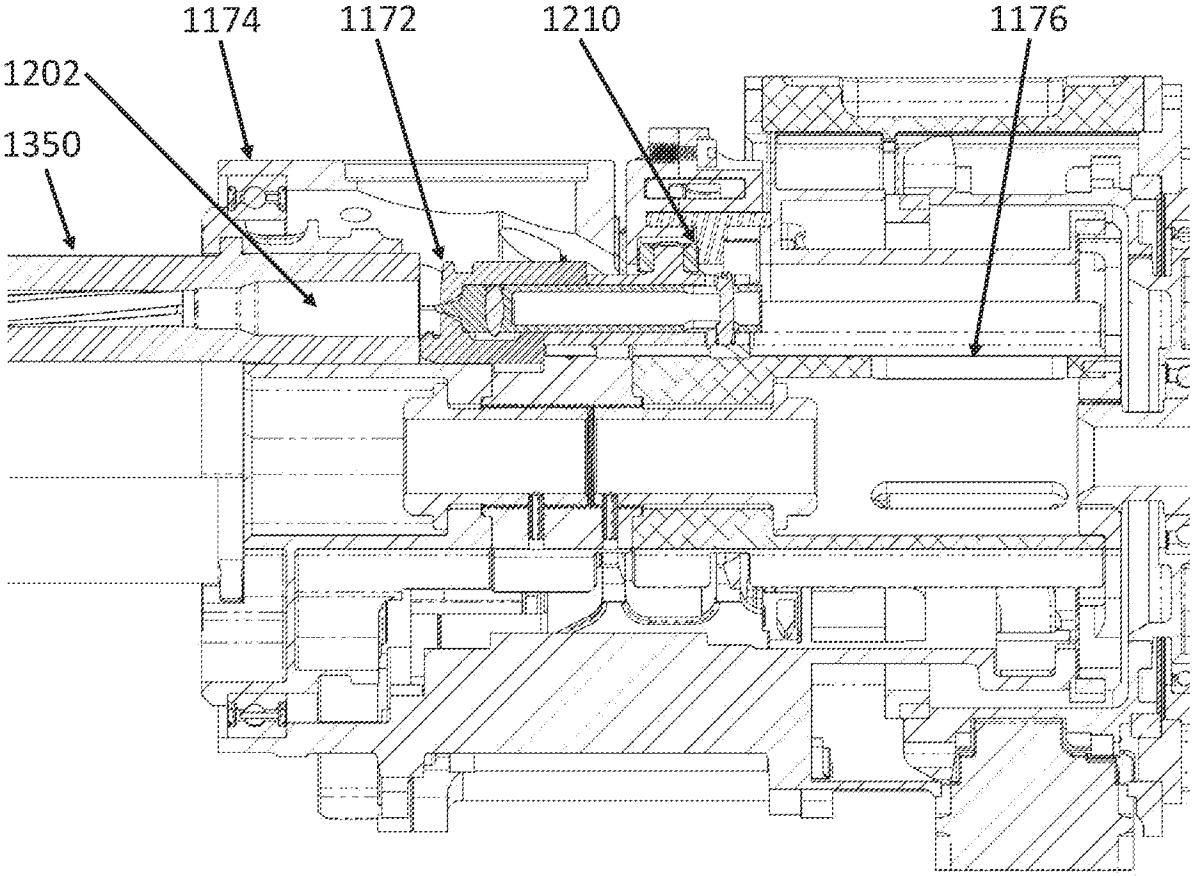
FIG. 14 is a cross-sectional view of gun housing of the multiple-barrel firearm of FIG. 1.

With reference to FIG. 7, the delinking and transfer mechanism 1100 of the multiple-barrel machine gun 1000 will be described. The delinking and transfer mechanism 1100 includes a reciprocating delinking shuttle 1170 and a barrel cam 1180 operably associated with the reciprocating delinking shuttle 1170 to control linear movement of a reciprocating delinking shuttle 1170 to delink and transfer each round into the bolt face 1172 (FIG. 14). The delinking and transfer mechanism 1100 includes meshing gears 1150, transfer sprocket 1140, guide bar 1130, precision locating boss 1190, and spring-loaded quick-release over-center locking latch 1160. The delinking and transfer mechanism 1100 is driven off the barrel cluster rotor assembly 1030 using the meshing gears 1150. The gears 1150 continuously rotate barrel cam 1180 which controls delinking shuttle 1170 in a linear reciprocating motion to transfer a delinked round from the feed mechanism 1048 into transfer sprocket 1140. The round is then rotated around the transfer sprocket 1140 and controlled by guide bar 1130 to increase tangential velocity for handoff into the bolt face 1172. The delinking and transfer mechanism 1100 is attached to the gun housing 1174 by precision locating boss 1190 and held into place using the spring-loaded quick-release over-center locking latch 1160.

Figure 8:
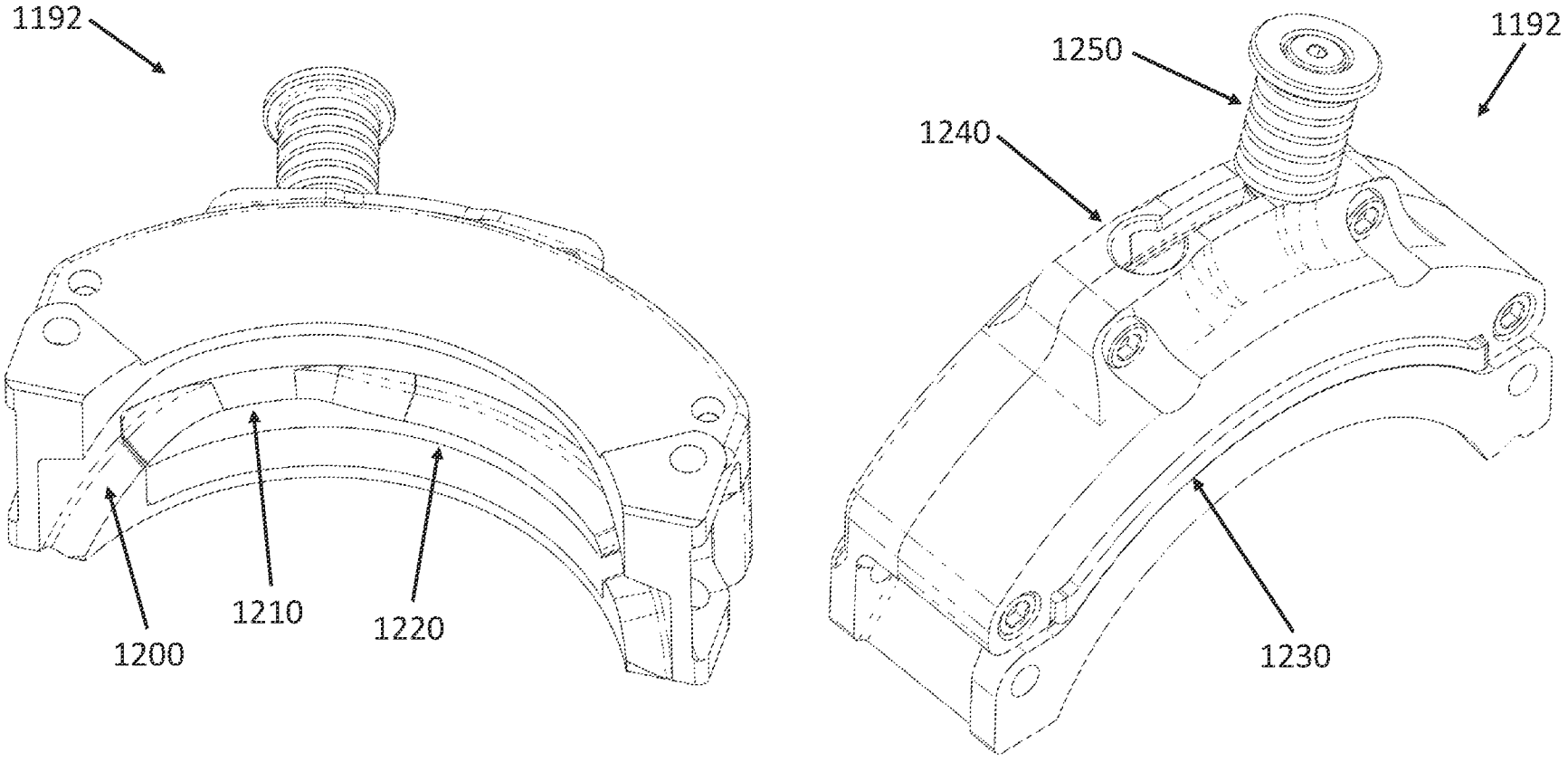
FIG. 8 illustrates perspective views of a searing mechanism of the multiple-barrel firearm of FIG. 1.

With reference to FIG. 8, a searing mechanism 1192 of the multiple-barrel machine gun 1000 will be described. The searing mechanism 1192 includes a longitudinally movable bolt searing ramp 1210, allowing additional safety to control firing pin action. The searing mechanism 1192 includes initial ramp 1200, spring-loaded knob 1250, ramp 1210, flat path 1220, safe position 1240, and bolt ramp slide 1230. The searing mechanism 1192 utilizes longitudinal translation of the bolt searing ramp 1210 to allow operator additional safety to control the firing pin action. After a delinked round is transferred into the bolt face 1172, the bolt follows the initial ramp 1200 to move round into barrel chamber 1202 (FIG. 14). If spring-loaded knob 1250 is in the fire position as shown in FIG. 8, the bolt will further follow searing ramp 1210 to sear the bolt, firing the round. The fired round will dwell in the barrel chamber 1202 as bolt follows flat path 1220 prior to extraction. If spring-loaded knob 1250 is in the SAFE position 1240, bolt ramp slide 1230 will move rearwards, causing the ramp 1210 to no longer sear the bolt as max position will coincide with end of initial ramp 1200.

Figure 15:
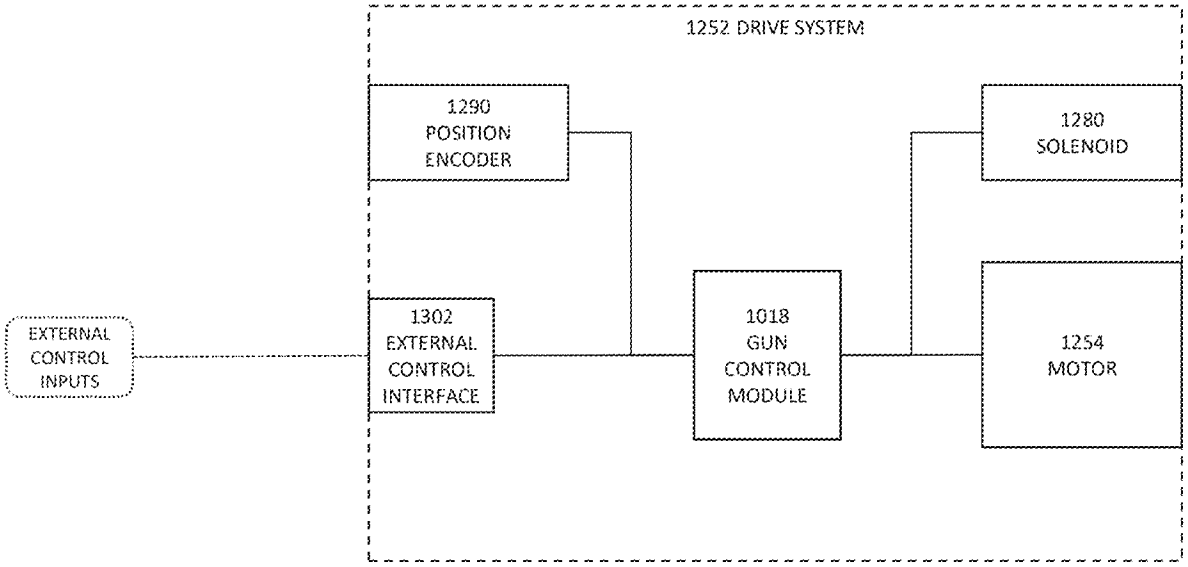
FIG. 15 is an electrical block diagram of an embodiment of electronic components of the multiple-barrel firearm of FIG. 1.

With reference to FIGS. 9 and 15, a drive system 1252 of the multiple-barrel machine gun 1000 will be described. The drive system 1252 includes a feedback control loop with brushless DC servo motor 1254 to rotate the rotor assembly 1030, position encoder sensor 1290, and a programmable drive, allowing variable rate of fire, and current and temperature sensing to offer instantaneous system status and motor control. Motor housing 1256 includes cooling features 1300, transferring excess heat to ambient environment to keep the motor temperature within operating range. The motor 1254 includes a rotating shaft 1260 with a keyed spline to ensure proper round handoff timing. The motor 1254 includes a stator bonded to motor housing 1022 and includes provisions for a bonded clutch solenoid 1280. The position encoder sensor 1290 is attached to the motor's rotating shaft 1260 and the motor housing 1022. The drive system 1252 includes an external control interface 1302, and a gun control module/processor 1018 including one or more software modules that are configured to, when executed by the gun control module/processor 1018, respond to external control signals to FIRE and electrically SAFE the weapon, engaging and disengaging the bonded clutch solenoid 1280, stopping rounds from being fed into rotor assembly. The gun control module 1018 controls the motor 1254 to run any remaining rounds through the firing cycle and spin the barrel cluster 1004 multiple times to ensure chambers 1202 are clear.

Figure 10:
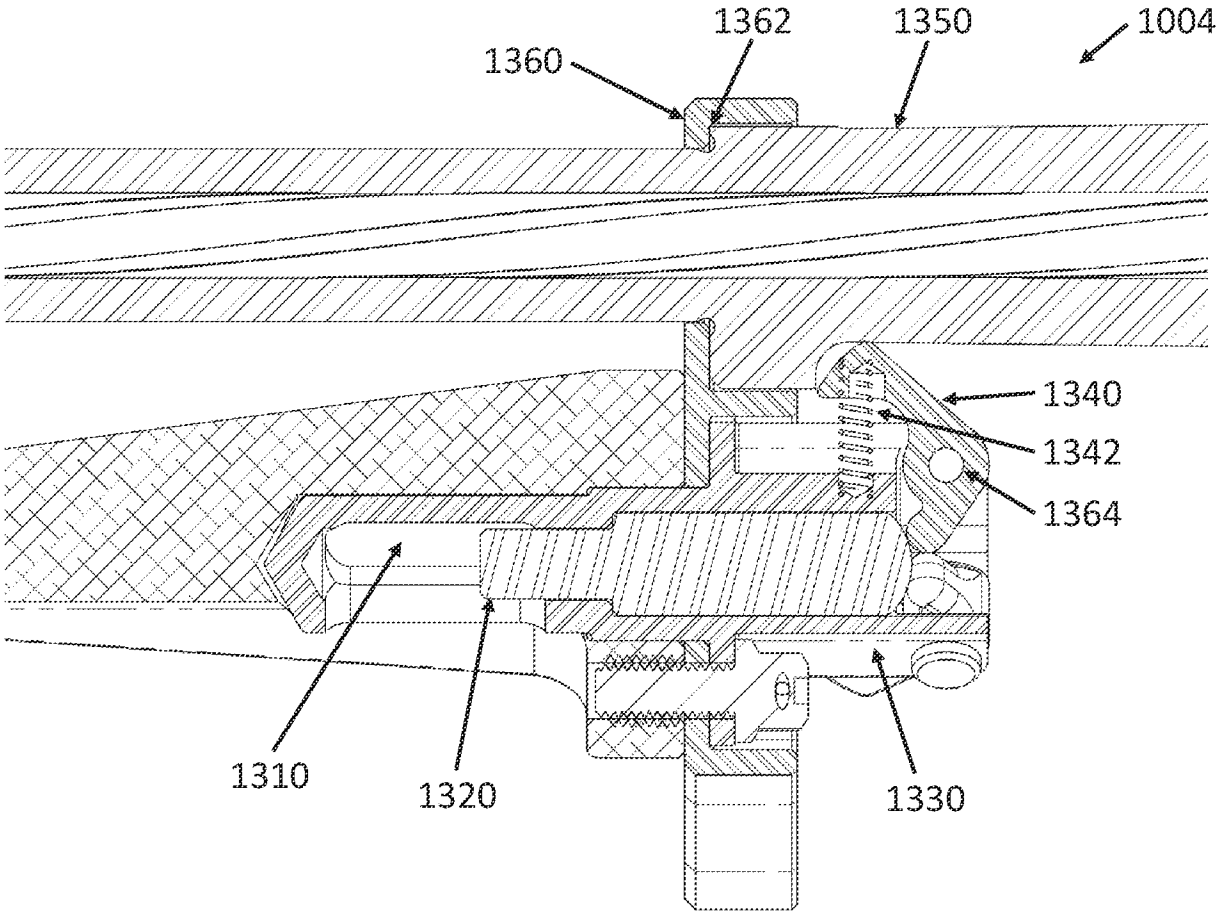
FIG. 10 is a cross-sectional view of a self-contained hardware barrel clamp of the multiple-barrel firearm of FIG. 1.

With reference to FIG. 10, a self-contained hardware barrel clamp 1360 of the multiple-barrel machine gun 1000 will be described. The self-contained hardware barrel clamp 1360 has no removable hardware, can be removed in a single motion with a screwdriver or similar tool, and is configured to prevent barrel cluster 1004 as a whole from rotating about its own axis. The barrel clamp 1360 includes a lock housing 1330 with a slot 1310, a lock plunger 1320, and a spring-loaded rotating barrel lock 1340 whereby the barrel clamp 1360 is removed via a tool (e.g., screwdriver) inserted into the slot 1310 so that force is applied to the lock plunger 1320, rotating spring-loaded rotating barrel lock 1340, and allowing the barrel clamp 1360 to slide off the barrel cluster 1004. The barrel clamp 1360 is located against feature 1362 on barrel 1350. The barrel clamp lock housing 1330 contains provisions for barrel locks 1340 and pre-loaded compression springs 1342 to prevent barrel clamp 1360 from sliding forward on barrels 1350. The barrel locks 1340 have an offset center of gravity from pivot 1364 to utilize centrifugal force to ensure barrel clamp 1360 is locked to barrels 1350. During removal of the barrel clamp 1360, the screwdriver or similar tool is inserted into one of the slots 1310 of lock housing 1330, then force is applied to lock plunger 1320, rotating barrel locks 1340 while also compressing springs 1342, unlocking the barrel clamp 1360, and allowing it to slide off the barrel cluster 1004.

Figure 11:
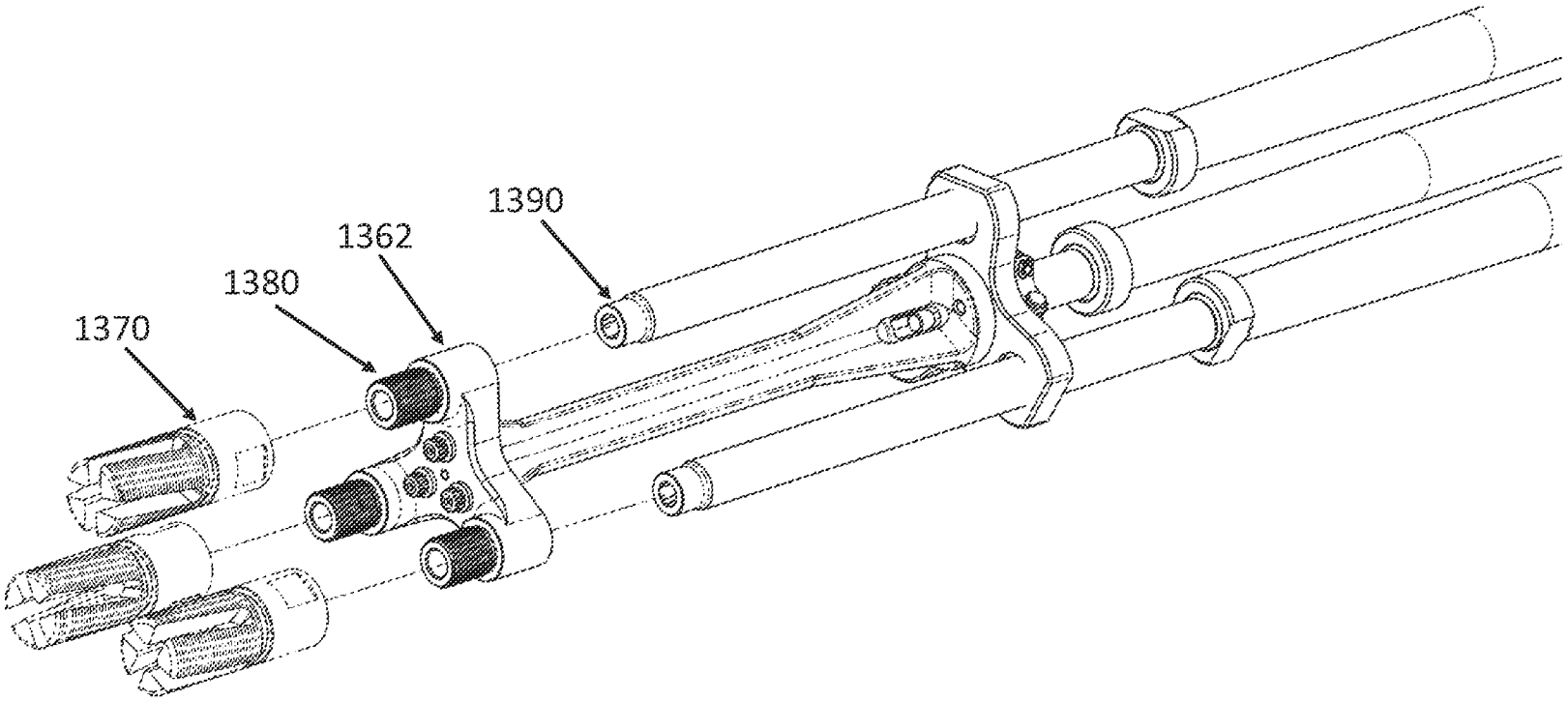
FIG. 11 is a perspective view of a threaded adapter barrel clamp of the multiple-barrel firearm of FIG. 1.

With reference to FIG. 11, a threaded adapter barrel clamp 1362 of the multiple-barrel machine gun 1000 will be described. The threaded adapter barrel clamp 1360 includes standard threaded features/threads 1380 to mount a multitude of muzzle devices 1370 (e.g., flash hiders, sound suppressors, other threaded muzzle devices) to non-threaded barrel end portions 1390 of the plurality of barrels 1350.

Figure 12:
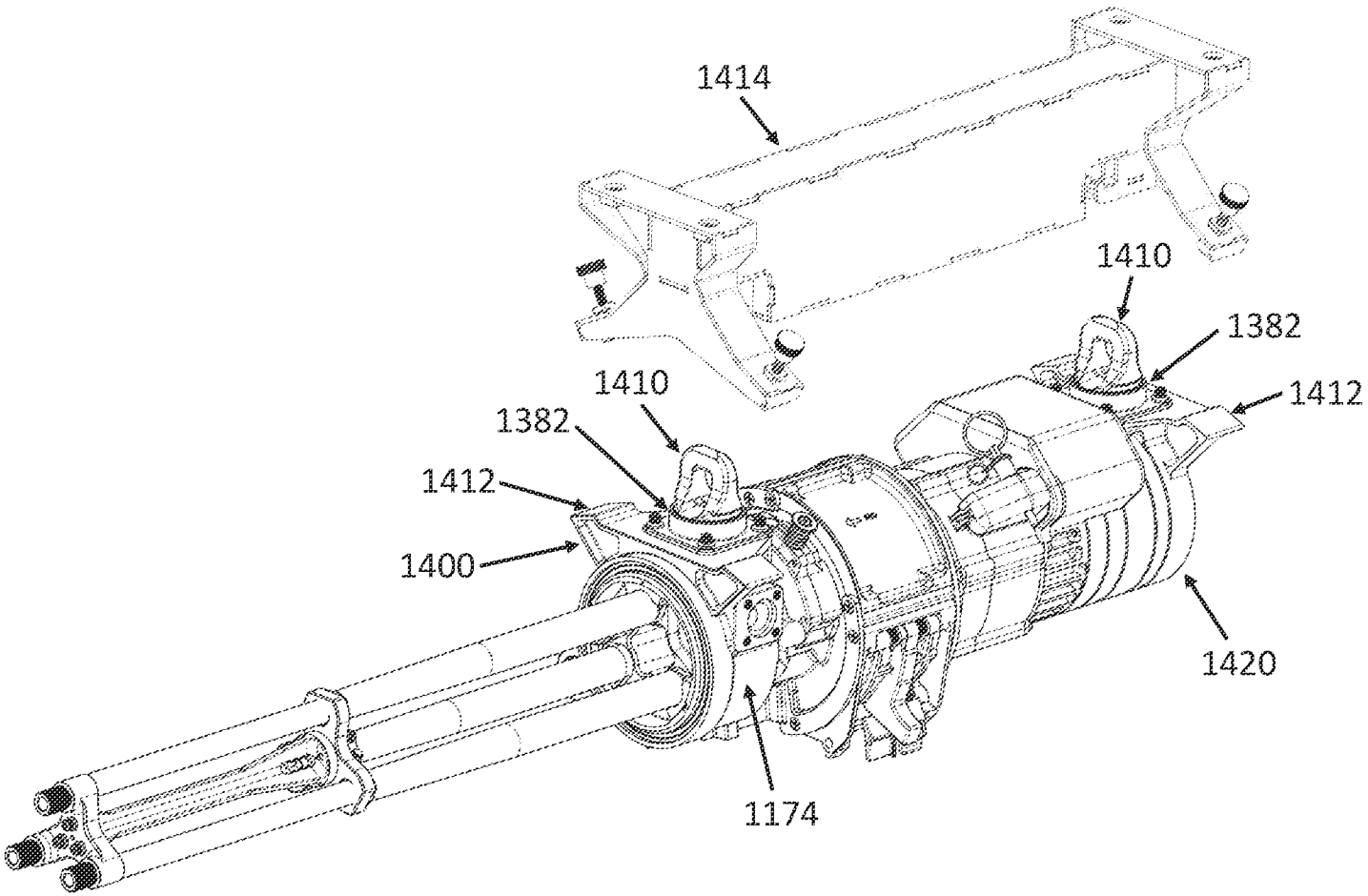
FIG. 12 is a cross-sectional view of integrated mounts for suspension lugs of the multiple-barrel firearm of FIG. 1.

With reference to FIG. 12, integrated mounts 1382 for suspension lugs 1410 of the multiple-barrel machine gun 1000 will be described. The gun housing 1174 includes one or more stabilizer adapters 1400, 1420 with the integrated mount(s) 1382 for direct integration of the suspension lug(s) 1410 for fixed forward applications. When mounted to a munitions release unit, forward stabilizer adapter 1400 includes pads 1412 to transfer any loads between release unit 1414 and main gun housing 1174. Aft stabilizer adapter 1420 also includes transfer pads 1412, while also containing the weapon's arm/safing sector mechanism. Most other gatling guns require intermediate hardback components to interface between weapon system and suspension lugs, adding unnecessary weight to the overall weapon system.

Figure 13:
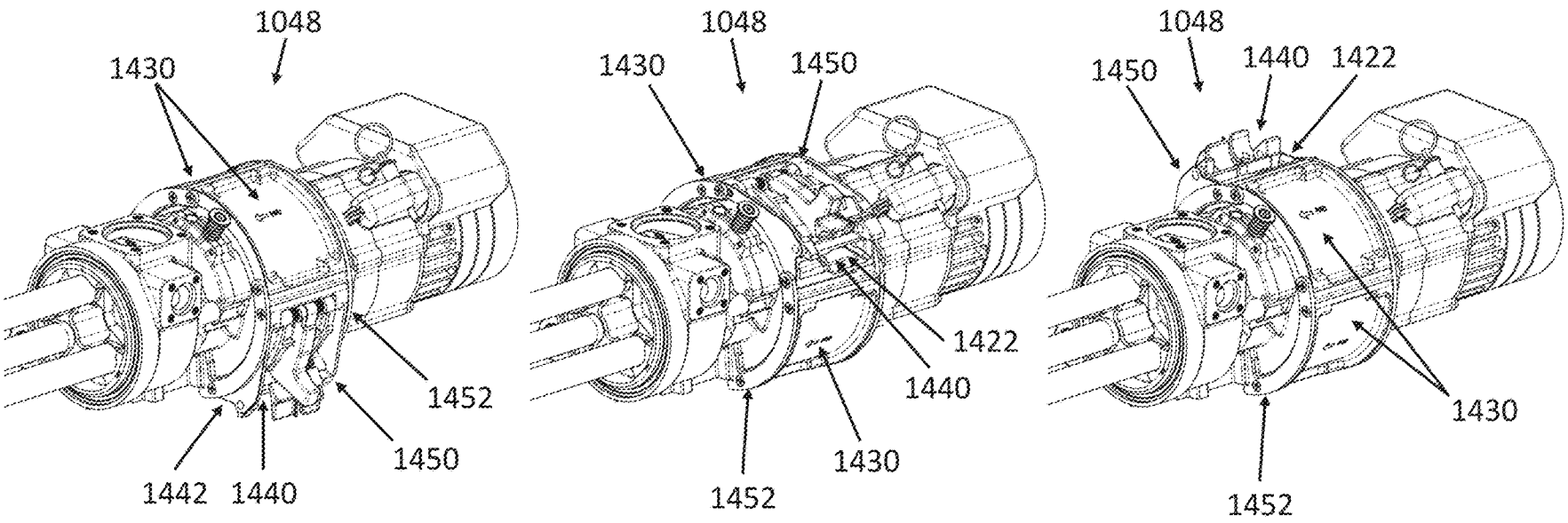
FIG. 13 illustrates perspective views of multiple feed inlet locations of the multiple-barrel firearm of FIG. 1.

With reference to FIG. 13, the feed mechanism 1048 includes a feed mechanism housing 1452 configured to allow for multiple feed inlet locations 1422 to optimize feed chute orientation based on system application. The feed mechanism 1048 includes a feed chute inlet 1440, a feeder door adapter 1450, and one or more feeder closeouts 1430. For the majority of crew serve applications, the feed mechanism housing 1452 is configured to allow for the feed chute inlet 1440 at a bottom of the feed mechanism housing 1452 with feeder door adapter 1450 mounted to a lowest position and the one or more feeder closeouts 1430 located in a top of the feed mechanism housing 1452. For fixed forward applications as well as some crew serve applications, the feed mechanism housing 1452 is configured to allow for the feed chute inlet 1440 at one of the sides of the feed mechanism housing 1452 with feeder door adapter 1450 mounted to one of the sides of the feed mechanism housing 1452 and one or more feeder closeouts feeder closeouts 1430 located in remaining open slots of the feed mechanism housing 1452, or the feed mechanism housing 1452 is configured to allow for the feed chute inlet 1440 at the top of the feed mechanism housing 1452 with feeder door adapter 1450 mounted to the top of the feed mechanism housing 1452 and the one or more feeder closeouts 1430 located in remaining open slots of the feed mechanism housing 1452.

The above description of the disclosed embodiments is provided to enable any person skilled in the art to make or use the invention. Various modifications to these embodiments will be readily apparent to those skilled in the art, and the general principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly not limited.

The figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

We claim:

1. A machine gun comprising:
a gun housing;
a rotor assembly positioned within the gun housing;
a barrel cluster including a plurality of barrels extending forward from the rotor assembly;
one or more vents providing a path for expulsion away from the rotor assembly of gases emanating from a cartridge chambered in one of the plurality of barrels;
a motor configured to rotate the rotor assembly,
a motor housing, and
a rotor lock mechanism configured to lock the rotor assembly directly to the motor housing, preventing rotation of the barrel cluster.

2. A machine gun comprising:
a gun housing;
a rotor assembly positioned within the gun housing;
a barrel cluster including a plurality of barrels extending forward from the rotor assembly;
one or more vents providing a path for expulsion away from the rotor assembly of gases emanating from a cartridge chambered in one of the plurality of barrels;
a feed mechanism with a feeder sprocket that is concentric to and rotates in an opposite direction of the barrel cluster so as to cause an inertial load of the feed mechanism to counteract an inertial load of the barrel cluster.

3. The machine gun of claim 2, further including a motor configured to rotate the rotor assembly, a bonded clutch solenoid, an external control interface, and a gun control module including a processor and one or more software modules that are configured to, when executed by the processor, respond to external control signals to disengage the bonded clutch solenoid, stopping rounds from being fed into the rotor assembly, the gun control module further configured to control the motor to run any remaining rounds through the firing cycle and spin the barrel cluster multiple times to ensure chambers are clear, and electrically safe the machine gun.

4. The machine gun of claim 2, further including a searing mechanism having a longitudinally movable bolt searing ramp.

5. The machine gun of claim 2, further including a drive system having a feedback control loop with a brushless DC servo motor, a position encoder sensor, and a programmable drive, allowing variable rate of fire, and current and temperature sensing.

6. The machine gun of claim 2, wherein the motor is configured to rotate the rotor assembly and a motor housing with cooling features, transferring excess heat to ambient environment.

7. The machine gun of claim 2, wherein the plurality of barrels include respective non-threaded barrel end portions and further including a threaded adapter barrel clamp with threads to mount a multitude of muzzle devices to the non-threaded barrel end portions.

8. The machine gun of claim 2, further including one or more stabilizer adapters.

9. The machine gun of claim 8, wherein the one or more stabilizer adapters include integrated mounts for suspension lugs.

10. The machine gun of claim 8, wherein the one or more stabilizer adapters include load transferring pads.

11. A machine gun comprising:
a gun housing;
a rotor assembly positioned within the gun housing;
a barrel cluster including a plurality of barrels extending forward from the rotor assembly;
one or more vents providing a path for expulsion away from the rotor assembly of gases emanating from a cartridge chambered in one of the plurality of barrels;
a delinking and transfer mechanism including a non-rotating reciprocating delinking shuttle and a rotating barrel cam operably associated with the non-rotating reciprocating delinking shuttle to control linear movement of the non-rotating reciprocating delinking shuttle to delink and transfer each round.

12. A machine gun comprising:
a gun housing;
a rotor assembly positioned within the gun housing;
a barrel cluster including a plurality of barrels extending forward from the rotor assembly;
one or more vents providing a path for expulsion away from the rotor assembly of gases emanating from a cartridge chambered in one of the plurality of barrels;
a self-contained hardware barrel clamp configured to prevent each barrel of the plurality of barrels from rotating about an axis thereof,
wherein the barrel clamp includes a lock housing with a slot, a lock plunger, and a spring-loaded rotating barrel lock whereby the barrel clamp is removable from the barrel cluster by inserting a tool into the slot of the lock housing, applying a force to the lock plunger, rotating the spring-loaded rotating barrel lock, and sliding the barrel clamp off the barrel cluster.

13. A machine gun comprising:
a gun housing;
a rotor assembly positioned within the gun housing;
a barrel cluster including a plurality of barrels extending forward from the rotor assembly;
one or more vents providing a path for expulsion away from the rotor assembly of gases emanating from a cartridge chambered in one of the plurality of barrels;
further including a feed mechanism with a feed mechanism housing configured to allow for a single feed inlet location of multiple possible feed inlet locations.

14. The machine gun of claim 13, wherein the feed mechanism includes a feed chute inlet, a feeder door adapter, and one or more feeder closeouts, the feed mechanism housing includes a bottom, sides, and a top, and the feed mechanism housing is configured to allow for the feed chute inlet at one of the bottom, the sides, and the top at a time.

* * * * *